United States Patent [19]

Szostak et al.

[11] 4,448,141

[45] May 15, 1984

[54] SEWING MACHINE CAM CONTROLLED FEED ENGAGING AND DISENGAGING MECHANISM

[75] Inventors: Jan Szostak, Lincroft; Henry Schaeflern, Pittstown; Walter H. W. Marsh, Scotch Plains, all of N.J.

[73] Assignee: The Singer Company, Stamford, Conn.

[21] Appl. No.: 514,136

[22] Filed: Jul. 15, 1983

[51] Int. Cl.[3] ..... D05B 27/22

[52] U.S. Cl. ..... 112/315; 112/158 A

[58] Field of Search ..... 112/315, 316, 317, 314, 112/158 A, 158 R, 158 B, 158 C

[56] References Cited

U.S. PATENT DOCUMENTS

| | | | |
|---|---|---|---|
| 3,043,253 | 7/1962 | Wank et al. | 112/316 X |
| 3,060,875 | 10/1962 | Iida | 112/316 X |
| 3,091,200 | 5/1963 | Fukunaga | 112/158 A |
| 3,753,411 | 8/1973 | Graham et al. | 112/315 |

*Primary Examiner*—H. Hampton Hunter

*Attorney, Agent, or Firm*—Robert E. Smith; Edward L. Bell

[57] ABSTRACT

A sewing machine work feed regulating arrangement is disclosed including a manual control dial for setting the magnitude and direction of work feed and a pattern cam for automatically influencing feed magnitude and direction. Control cam means associated with the manual control dial and effective during a small angular dwell segment thereof influences separate follower means positively to effect either engagement or disengagement of the pattern cam control of the work feed.

3 Claims, 4 Drawing Figures

SEWING MACHINE CAM CONTROLLED FEED ENGAGING AND DISENGAGING MECHANISM

DESCRIPTION

Background of the Invention

This invention relates to sewing machines having means for controlling the magnitude and direction of work feed in response to stored pattern data, as for instance, on a pattern cam to produce stitch patterns in which the work feed is automatically varied, and more particularly, to a novel and improved operator influenced mechanism for positively engaging and disengaging the pattern controlled feed. The mechanism of this invention requires for its operation such a small segment of movement of an operator influence control member that it may be applied to almost any sewing machine feed control dial or other control member.

DESCRIPTION OF THE PRIOR ART

Devices which are known for engaging and disengaging a pattern cam for the sewing machine work feed in response to operation of a control element which is separate from the manual feed regulating contol not only result in confusing multiplication of control elements on the sewing machine but they can result in undesirable conflict between the effect of the various controls. Devices which are known for influencing engagement and disengagement of a pattern cam for the sewing machine work feed in response to an extreme position of adjustment of the manual feed regulating lever or the like effect engagement of the pattern cam in a positive manner but rely upon a return spring for disengaging the pattern cam and the return spring can adversely favor cam influenced work feed regulation in one direction.

SUMMARY OF THE INVENTION

It is an object of this invention to provide an engaging and disengaging mechanism for a sewing machine pattern controlled feed which is influenced by a simple cam lobe occupying only a few degrees of angular segment of a manual feed control dial which cam lobe is engaged by a novel and effective follower arrangement so as to influence both engagement and disengagement of the cam controlled feed in a positive manner.

DESCRIPTION OF THE DRAWINGS

With the above and additional objects and advantages in view, as will hereinafter appear, this invention will now be described with reference to a preferred embodiment illustrated in the accompanying drawing in which.

DESCRIPTION OF THE PREFERRED EMBODIMENT

Figure 1:
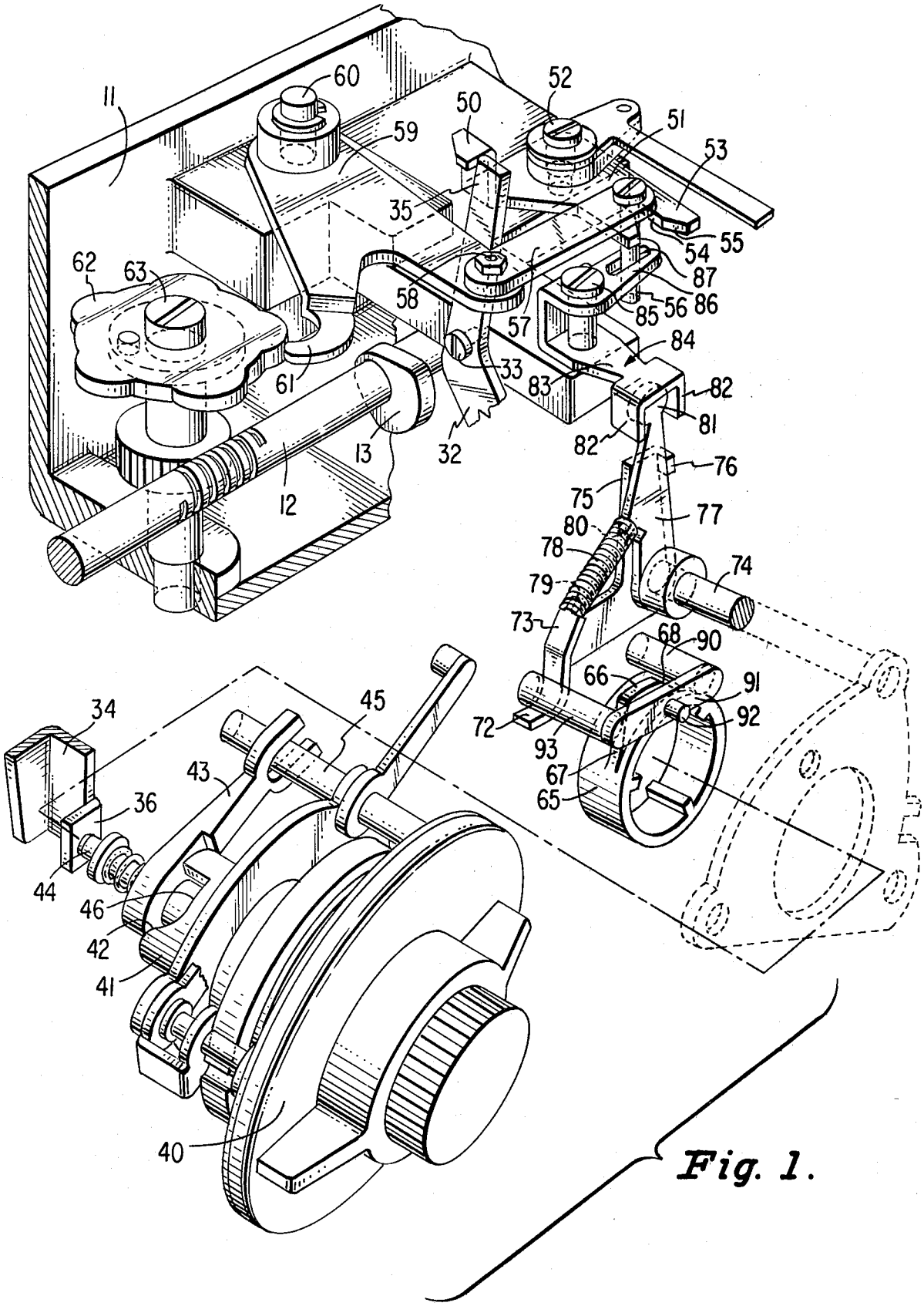
FIG. 1 is a front perspective view of a portion of a sewing machine bracket arm with a manual feed control assembly separated therefrom to illustrate more clearly the cam engaging and disengaging mechanism of this invention applied thereto.

This invention has utility with a sewing machine having any conventional work feeding mechanism which is capable of regulation to vary the magnitude and direction in which the work fabrics are fed, and particularly those in which manual regulation of the work feed is accomplished by means of a rotary element such as a dial or the like. U.S. Pat. No. 3,753,411, Aug. 21, 1973 of Graham et al, which illustrates one such sewing machine is incorporated herein by reference.

As shown in the accompanying drawings, 11 indicates the frame of a sewing machine in which a main drive shaft 12 is journaled. Fast on the main driver shaft 12 is a constant breadth cam 13 which is embraced by the bifurcated head 14 of a feed advance drive pitman 15. Pivotally secured on a pin 16 to the pitman 15 is a slide block 17 constrained in a guide slot 18 of a feed regulating block 19 which is pivotally supported on a pivot pin 20 on the the machine frame. The angular position of the feed regulating block determines the magnitude and direction of fabric feed, that is, the stitch length and direction of fabric feed. Since any conventional work feeding mechanism such as a four-motion drop feed mechanism may be used with this invention, a complete sewing machine work feeding mechanism is not shown in the accompanying drawings.

A pin 30 secured to the feed regulartor block 19 in spaced relation to the pviot pin 20 is embraced by a slot 31 formed in a lever 32 fulcrummed on a pin 33 fixed in the machine frame 11. The lever 32, which thus influences the angular position of the feed regulator block 19, is formed with a downturned arm 34 which is positioned for engagement by a manually influenced control member, as will be described below, and the lever 32 is also formed with an upturned arm 35 which is positioned for engagement by a pattern cam influenced control which will also be described below.

Figure 2:
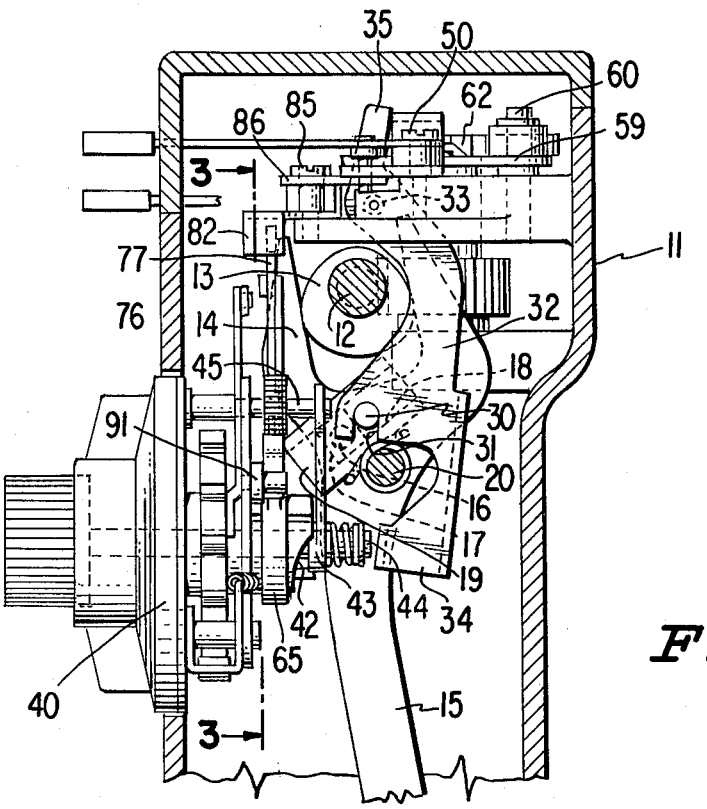
FIG. 2 is a right side elevational view of the parts shown in FIG. 1 with the sewing bracket arm illustrated in vertical cross section.
Figure 3:
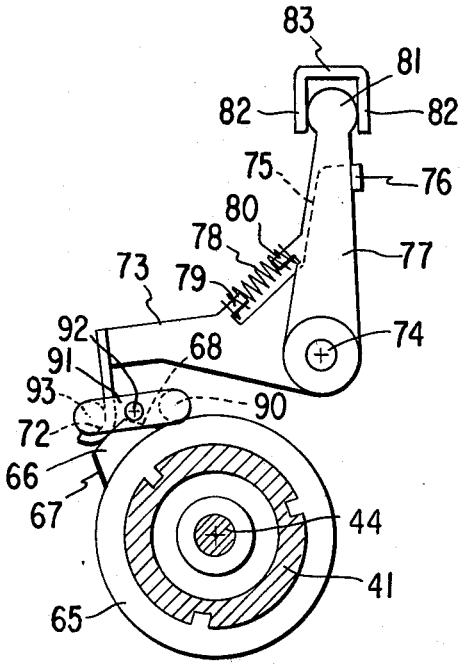
FIG. 3 is an enlarged cross-sectional view taken substantially along line 3—3 of FIG. 2 showing the position of the cam engaging and disengaging parts in the position in which the work feed pattern cam is engaged.
Figure 4:
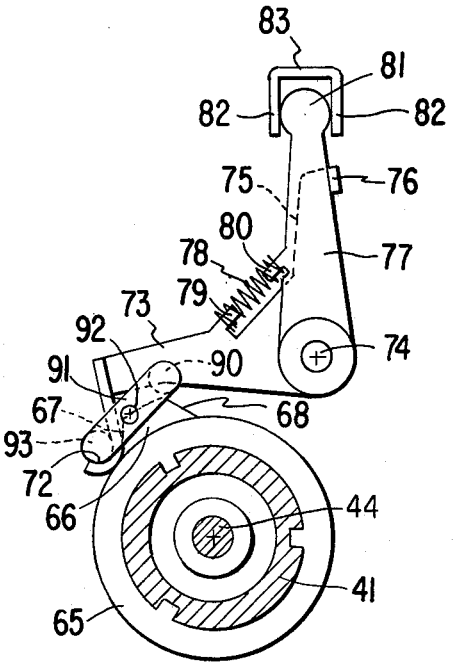
FIG. 4 is a cross-sectional view similar to that of FIG. 3 but showing the parts in the disengaged position of the work feed pattern cam.

The manually influenced control member, as best illustrated in FIGS. 1 and 2 of the drawings, includes an operator influenced dial 40 journaled in the frame 11 of the sewing machine and formed integrally with cylindrical boss 41 having a face cam surface 42 engaged by a radial follower arm 43 carried on a plunger 44 slidable axially of the face cam surface 42. The follower arm 43 may also slidably engage a guide stud 45 carried in the machine frame. The plunger 44 is arranged for engagemet with a tab 36 on the downturned arm 34 of the lever 32. Preferrably, the face cam surface 42 includes a dwell segment 46 extending for approximately 30 degrees of the cylindrical boss 41 which, when tracked by the follower arm 43, dictates the work feed regulation be maintained in maximum stitch length in the forward direction.

Referring to FIG. 1, the upturned arm 35 of the lever 32 extends in the path of movement of an arm 50 of a bell crank 51 fulcrummed on a pin 52 carried in the machine frame 11. The other arm 53 of the bell crank lever 51 is formed with a radial slot 54 having a flaired mouth 55.

A pin 56 depending from connecting link 57 is adapted selectively to be shifted into and out of the bell crank lever slot 54 as will be described hereinbelow. The connecting link 57 is pivoted by a shouldered screw 58 to a pattern cam follower lever 59 sustained on a pivot pin 60 in the machine frame and formed with a cam follower finger 61 adapted to track the periphery of a feed controlling pattern cam 62 fast on a cam shaft 63 driven from the main drive shaft 12.

For selectively engaging or disengaging the feed pattern cam follower lever 59 and the link 57, collectively referred to as the feed advance cam tracking mechanism, with the lever 32 which influences the stitch length and direction of work feed, a sleeve 65 is secured to the cylindrical boss 41 of the manual stitch length regulating dial 40. A single radial cam lobe 66 is formed on the sleeve 65 and arranged to occupy only a small angular segment thereof which need not exceed 30 degrees. The cam lobe 66 is formed with a first radially varying slope 67 at one side and with a second radially varying slope 68 at the other side.

Tracking the radially varying slope 67 of the cam lobe 66 while the dwell segment 46 of the face cam 42 is effective, is a cup-shaped follower finger 72 formed on a follower lever 73 fulcrummed on a pin 74 carried in the machine frame 11. An upturned arm 75 on the follower lever 73 is formed with an offset finger 76 engaging a rock arm 77 also journaled on the pin 74. A compression spring 78 constrained between a seat 79 formed on the follower lever 73 and a seat 80 formed on the rock arm 77 biases the rock arm toward the offset finger 76. The rock arm 77 terminates in a circular head 81 which is embraced between the flanges 82 depending from one arm 83 of a bell crank 84 pivoted on a pin 85 in the machine frame. A second arm 86 of the bell crank 84 is formed with a radial slot 87 which embraces the pin 56.

As the operator influenced control member 40 is shifted into the range in which the dwell segment 46 of the cam 42 is effective, the slope 67 of the cam lobe 66 will act positively on the follower finger 72 to engage the feed pattern cam control with the work feed regulator by swinging the pin 56 on the link 57 into the slot 54 of the bell crank lever 51. No spring bias is provided urging the feed pattern cam control either into or out of engagement so that retrograde movement of the slope 67 of the cam lobe 66 will not of itself shift the feed pattern cam control positively out of engagement. In fact, it is preferrable that the link 57 in the engaged position occupy a position slightly beyond the direct line of forces transmitted through the link so that the mechanism will have a slight tendency to maintain the engaged position.

For positively disengaging the feed pattern cam control upon retrograde movement of the operator influenced control dial 40, a roller follower 90 is provided on a follower lever 91 pivoted at 92 in the machine frame so that the roller follower tracks the radial slope 68 of the cam lobe 66. At the opposite extremity of the follower lever 91 a roller 93 is provided which engages the cup-shaped follower finger 72 of the follower lever 73 at the opposite side of the finger 72 from that which tracks the radial slope 67 of the cam lobe 66.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. In a sewing machine having a frame, a work feed regulator shiftably supported in said frame the position of which dictates the magnitude and direction of work feed, an operator influenced control member shiftably supported in said frame and having an operative connection with said work feed regulator effective to locate said work feed regulator in position dictating any selected magnitude and direction of feed, said operative connection between said operator influenced control member and said work feed regulator including means for providing a dwell segment of control member movement in which the position of said work feed regulator dictated by said operator influenced control member remains in maximum magnitude and forward direction of feed, a feed advance pattern cam carried by said sewing machine frame and driven by said sewing machine, a feed advance cam tracking mechanism carried by said sewing machine frame, connection means selectably engageable or disengageable between said feed advance cam tracking mechanism and said work feed regulator, and means for positively engaging and disengaging said connection means comprising:

cam means carried by said operator influenced control member and including separate engaging and disengaging cam surfaces, engaging and disengaging cam follower means supported on said sewing machine frame and arranged for positive influence by said engaging and disengaging cam surfaces respectively during said dwell segment of control member movement, said engaging cam follower means being operatively coupled to said connection means, and said disengaging cam follower means being operatively coupled to said engaging cam follower means.

2. A sewing machine feed pattern cam engaging and disengaging mechanism as set forth in claim 1 in which said operator influenced control member comprises a dial rotatably journaled in said sewing machine frame, in which said cam means carried on said control member comprises a radial cam lobe, said engaging cam surface comprising the radially varying slope at one side of said cam lobe and said disengaging cam surface comprising the radially varying slope at the other side of said cam lobe.

3. A sewing machine feed pattern cam engaging and disengaging mechanism as set forth in claim 1 in which said engaging cam follower means comprises a lever at one extremity operatively engaging said connection between said feed advance cam tracking mechanism and said work feed regulator and at the opposite extremity being formed with a cup-shaped follower finger arranged to be engaged and positively shifted by said engaging cam surface on said control dial, and in which said disengaging cam follower means comprises a lever of the first classcarrying at one extremity a roller arranged to be engaged and positively shifted by said disengaging cam surface on said control dial, and carrying at the opposite extremity a roller engaging the cup-shaped follower finger of the engaging cam follower means.

* * * * *